US009759407B2

(12) United States Patent
Yang et al.

(10) Patent No.: US 9,759,407 B2
(45) Date of Patent: Sep. 12, 2017

(54) OPTO-MECHANICALLY ADJUSTABLE AND EXPANDABLE LIGHT FIXTURES

(71) Applicants: Yi Yang, Liverpool, NY (US); Daniel Robert Treible, Jr., Clay, NY (US)

(72) Inventors: Yi Yang, Liverpool, NY (US); Daniel Robert Treible, Jr., Clay, NY (US)

(73) Assignee: Cooper Technologies Company, Houston, TX (US)

( * ) Notice: Subject to any disclaimer, the term of this patent is extended or adjusted under 35 U.S.C. 154(b) by 529 days.

(21) Appl. No.: 14/180,118

(22) Filed: Feb. 13, 2014

(65) Prior Publication Data

US 2015/0226407 A1 Aug. 13, 2015

(51) Int. Cl.

| | |
|---|---|
| ***F21S 4/00*** | (2016.01) |
| ***F21V 15/01*** | (2006.01) |
| ***F21K 9/00*** | (2016.01) |
| ***F21V 19/00*** | (2006.01) |
| ***F21V 14/02*** | (2006.01) |
| ***F21V 21/30*** | (2006.01) |
| *F21Y 105/10* | (2016.01) |
| *F21Y 115/10* | (2016.01) |

(52) U.S. Cl.

CPC ..... *F21V 15/01* (2013.01); *F21K 9/00* (2013.01); *F21V 14/02* (2013.01); *F21V 19/003* (2013.01); *F21V 21/30* (2013.01); *F21Y 2105/10* (2016.08); *F21Y 2115/10* (2016.08)

(58) Field of Classification Search

CPC .. F21S 4/008; F21S 8/036; F21S 8/028; F21S 8/026; F21S 8/033; F21V 15/01; F21V 21/30; F21V 21/008; F21V 21/002; F21V 21/06; F21V 21/14; F21V 21/104; F21V 21/108; F21V 21/12; F21V 21/22; F21V 21/28; F21W 2131/20

USPC ..... 362/249.01, 249.02, 249.03

See application file for complete search history.

(56) References Cited

U.S. PATENT DOCUMENTS

| | | | | |
|---|---|---|---|---|
| 4,525,773 A | | 6/1985 | Hesse et al. | |
| 6,079,856 A | * | 6/2000 | Prestier | E04B 9/006 362/145 |
| 7,311,423 B2 | | 12/2007 | Frecska et al. | |
| 7,637,636 B2 | | 12/2009 | Zheng et al. | |

(Continued)

OTHER PUBLICATIONS

Leyan Wang, Chinese Office Action issued in application No. 201510080988.1, dated May 17, 2017, 6 pages, The State Intellectual Property Office of China.

(Continued)

*Primary Examiner* — Anh Mai
*Assistant Examiner* — Matthew Peerce
(74) *Attorney, Agent, or Firm* — King & Spalding LLP

(57) ABSTRACT

A housing for a light fixture is described herein. The housing can include a first housing portion having at least one first coupling feature and at least one first receiving feature, where the at least one first receiving feature is configured to receive at least one first light module at a first adjustable distance from the first housing. The housing can also include a second housing portion having at least one second coupling feature, where the at least one second coupling feature mechanically couples to the at least one first coupling feature. A position of the first housing portion relative to the second housing portion can be changed using the at least one first coupling feature and the at least one second coupling feature.

20 Claims, 6 Drawing Sheets

(56) References Cited

U.S. PATENT DOCUMENTS

| | | | | |
|---|---|---|---|---|
| 7,665,862 | B2 | 2/2010 | Villard | |
| 7,703,941 | B2 | 4/2010 | Lee | |
| 7,810,968 | B1 | 10/2010 | Walker et al. | |
| 7,854,534 | B2 | 12/2010 | Liu | |
| 7,926,982 | B2 | 4/2011 | Liu | |
| 7,988,335 | B2 | 8/2011 | Liu et al. | |
| 8,002,438 | B2 | 8/2011 | Ko | |
| 8,025,428 | B2 | 9/2011 | Duguay et al. | |
| 8,092,047 | B2 | 1/2012 | Ma et al. | |
| 8,454,194 | B2 | 6/2013 | Liu | |
| 8,459,835 | B2 | 6/2013 | Liu et al. | |
| 8,529,076 | B2 | 9/2013 | Chang | |
| 8,770,816 | B2 | 7/2014 | Parker et al. | |
| 2005/0254263 | A1* | 11/2005 | Harwood | F21S 2/005 362/648 |
| 2010/0118532 | A1 | 5/2010 | Liang et al. | |
| 2010/0172133 | A1 | 7/2010 | Liu | |
| 2010/0220046 | A1 | 9/2010 | Plotz et al. | |
| 2011/0109235 | A1 | 5/2011 | Link | |
| 2011/0310600 | A1 | 12/2011 | Lehman et al. | |
| 2012/0033426 | A1 | 2/2012 | Wendt | |
| 2012/0127713 | A1 | 5/2012 | Lee | |
| 2012/0140468 | A1 | 6/2012 | Chang | |
| 2012/0155080 | A1 | 6/2012 | Schupple et al. | |
| 2012/0300460 | A1 | 11/2012 | Liu et al. | |
| 2013/0087722 | A1 | 4/2013 | Brown | |
| 2013/0088871 | A1 | 4/2013 | Yun et al. | |
| 2013/0229802 | A1 | 9/2013 | Fukushima et al. | |
| 2013/0235583 | A1 | 9/2013 | Chang et al. | |
| 2013/0322099 | A1* | 12/2013 | Yasuji Fletcher | F21V 21/30 362/427 |
| 2014/0003053 | A1 | 1/2014 | Musser et al. | |
| 2014/0268775 | A1* | 9/2014 | Kennemer | F21L 14/00 362/249.03 |
| 2015/0070892 | A1 | 3/2015 | Witsch | |
| 2015/0117005 | A1 | 4/2015 | Zanotto et al. | |

OTHER PUBLICATIONS

English Translation of Chinese Office Action, dated May 17, 2017, 5 pages.

* cited by examiner

OPTO-MECHANICALLY ADJUSTABLE AND EXPANDABLE LIGHT FIXTURES

CROSS-REFERENCE TO RELATED APPLICATIONS

The present application is related to U.S. patent application Ser. No. 14/180,140 titled "Opto-Mechanically Adjustable and Expandable Light Boards," which is being filed concurrently with the U.S. Patent and Trademark Office, and is hereby incorporated by reference.

TECHNICAL FIELD

The present disclosure generally relates to light fixtures and, particularly, to adjustable and expandable light fixtures.

BACKGROUND

Light fixtures are used in a number of different applications. Many of these applications can apply to an industrial setting or similar settings where the light fixtures are mounted a large distance from where the light emitted by the light fixtures is projected. Having the capability to adjust such light fixtures to alter the intensity and/or distribution of the light emitted by the light fixtures can be useful.

SUMMARY

In general, in one aspect, the disclosure relates to a housing for a light fixture. The housing can include a first housing portion having at least one first coupling feature and at least one first receiving feature, where the at least one first receiving feature is configured to receive at least one first light module at a first adjustable distance from the first housing. The housing can also include a second housing portion having at least one second coupling feature, where the at least one second coupling feature mechanically couples to the at least one first coupling feature. A position of the first housing portion relative to the second housing portion can be changed using the at least one first coupling feature and the at least one second coupling feature.

In another aspect, the disclosure can generally relate to a light fixture. The light fixture can include at least one first light module and a housing. The housing of the light fixture can include a first housing portion having at least one first coupling feature and at least one first receiving feature, where the at least one first receiving feature mechanically couples to the at least one first light module. The housing of the light fixture can also include a second housing portion having at least one second coupling feature, where the at least one second coupling feature mechanically couples to the at least one first coupling feature. A first position of the first housing portion relative to the second housing portion can be changed using the at least one first coupling feature and the at least one second coupling feature.

These and other aspects, objects, features, and embodiments will be apparent from the following description and the appended claims.

BRIEF DESCRIPTION OF THE DRAWINGS

For a more complete understanding of the example embodiments and the advantages thereof, reference is now made to the following description, in conjunction with the accompanying figures briefly described as follows.

Figure 1A:
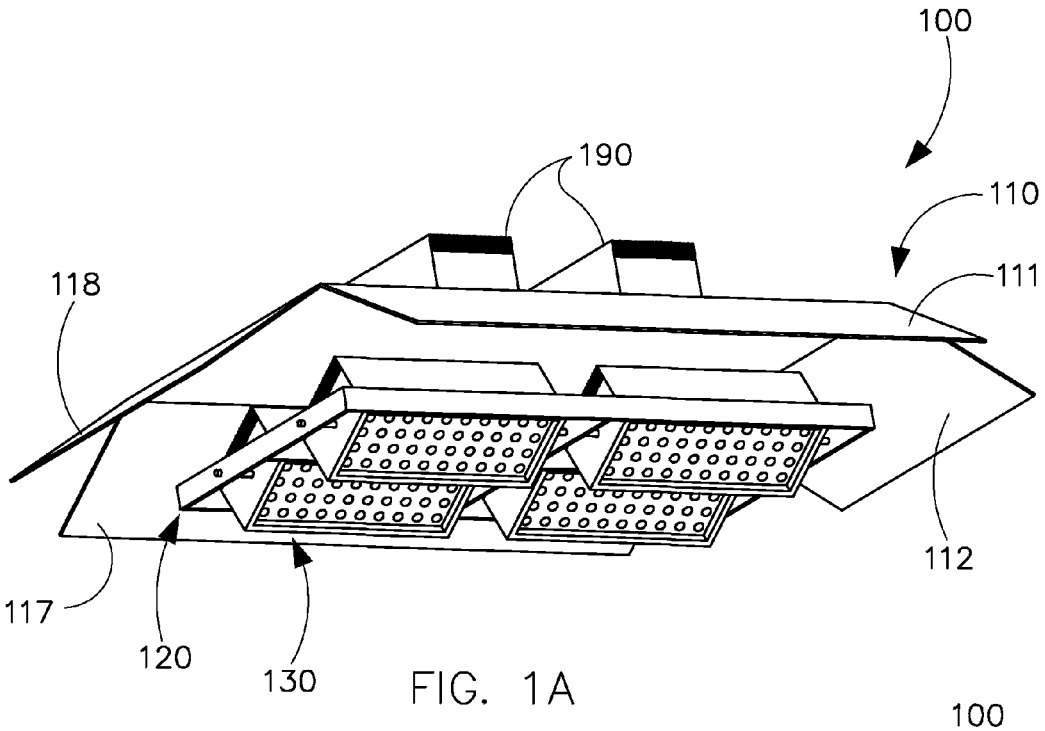
FIGS. 1A and 1B show various views of a light fixture in accordance with certain example embodiments.

The drawings illustrate only example embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

The example embodiments discussed herein are directed to systems, apparatuses, and methods of adjustable and/or expandable light fixtures. Such light fixtures can be one or more of a number of types of light fixtures used in one or more of a number of applications. One example type of light fixture is a high-bay light fixture. Example embodiments can be used with in one or more of a variety of environments, indoors or outdoors, where the light fixture can be exposed. Examples of such environments can include, but are not limited to, moisture, humidity, dirt, exhaust fumes, vibrations, potential explosions, and noise.

Example light fixtures can use light-emitting diode (LED) technology. If a light source of the light fixture is a LED, the LED can be of one or more of a number of types of LED technology, including but not limited to discrete LEDs, LED arrays, chip-on-board LEDs, edge lit LED panels, and surface mounted LEDs. Example light fixtures also can be used with different types of light sources using one or more of a number of types of sockets into which the light sources are electrically and mechanically coupled. Examples of a socket can include, but are not limited to, an Edison screw base of any diameter (e.g., E26, E12, E 14, E39), a bayonet style base, a bi-post base, a bi-pin connector base, a wedge base, and a fluorescent tube base. A light source can electrically and mechanically couple to the socket and can be of a light source type that corresponds to the socket. Examples of light source types of the light source can include, but are not limited to, incandescent lamps, LEDs, halogen lamps, G10/GU10, G9/GU9, AR111/PAR36, T3, MR-11, and MR-16.

Example light fixtures can be of any size and/or shape, and can have any number of sockets and/or wires. Such light fixtures can be mounted to a surface (e.g., wall, ceiling, pillar), be part of a lamp, or be used with any other suitable mounting instrument. Such light fixtures can be used in residential, commercial, and/or industrial applications. Such light fixtures can operate from a manual device (e.g., on/off switch, dimming switch, pull chain), a photocell, a timer, and/or any other suitable mechanism.

The example light fixtures (or components thereof) described herein can be made of one or more of a number of suitable materials to allow the light fixtures to meet certain standards and/or regulations while also maintaining durability in light of the one or more conditions under which the example light fixtures can be exposed. Examples of such materials can include, but are not limited to, aluminum, stainless steel, fiberglass, glass, plastic, and rubber.

Example light fixtures described herein can be rated for one or more of a number (or range) of light color (CCT), light accuracy (CRI), voltages, and/or amperes. Example light fixtures described herein should not be considered limited to a particular CCT, CRI, voltage, and/or amperage rating. A user may be any person who interacts with an example light fixture. Specifically, a user may install, maintain, operate, and/or interface with an example light fixture. Examples of a user may include, but are not limited to, an engineer, an electrician, an instrumentation and controls technician, a mechanic, an operator, a consultant, a contractor, and a manufacturer's representative.

Example embodiments of opto-mechanically adjustable and/or expandable light fixtures will be described more fully hereinafter with reference to the accompanying drawings, in which example light fixtures are shown. Opto-mechanically adjustable and/or expandable light fixtures may, however, be embodied in many different forms and should not be construed as limited to the example embodiments set forth herein. Rather, these example embodiments are provided so that this disclosure will be thorough and complete, and will fully convey the scope of opto-mechanically adjustable and/or expandable light fixtures to those or ordinary skill in the art.

Like, but not necessarily the same, elements (also sometimes called components) in the various figures are denoted by like reference numerals for consistency. Terms such as "first," "second," "side," "top," "bottom," "left," "right," "front," and "back" are used merely to distinguish one component (or part of a component) from another. Such terms are not meant to denote a preference or a particular orientation. Further, for any figures described below, labels not shown in such figures but referred to with respect to such figures can be incorporated by reference from one or more other figures described herein. Similarly, a description of a label shown in certain figures but not described with respect to such figures can use the description from other figures described herein.

Figure 1B:
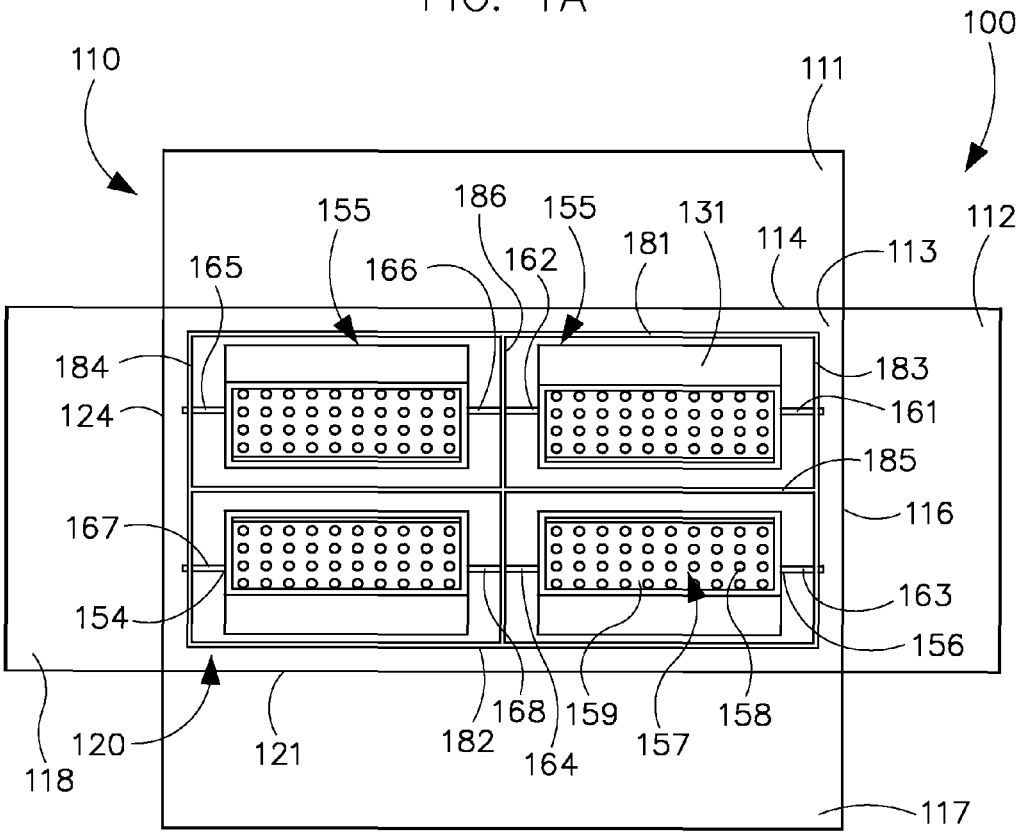

FIGS. 1A and 1B show various views of light fixture 100 in accordance with certain example embodiments. Specifically, FIG. 1A shows a side perspective view of the example light fixture 100. FIG. 1B shows a bottom view of the example light fixture 100. In one or more example embodiments, one or more of the components shown in FIGS. 1A and 1B may be omitted, repeated, and/or substituted. Accordingly, example embodiments of light fixtures (or portions thereof) should not be considered limited to the specific arrangements of components shown in FIGS. 1A and 1B.

Referring now to FIGS. 1A and 1B, the light fixture 100 can include the housing 110, a frame 120, one or more light modules 155, and at least one power source 190. The housing 110 can include one or more housing portions. In this case, there are five housing portions of the housing in FIGS. 1A and 1B. Specifically, one housing portion is housing portion 113, which is rectangular in shape. There are also two side flaps (housing portion 112 and housing portion 118) a top flap (housing portion 111), and a bottom flap (housing portion 117). Each of these flaps (housing portion 112, housing portion 111, housing portion 117, housing portion 118) is movably coupled to one side of housing portion 113.

Each housing portion can have any of a number of shapes and/or sizes. For example, a housing portion can be flat, curved, angled, and/or have any other contour. As another example, a housing portion can be rectangular, triangular, octagonal, or any other shape. A housing portion of the housing 110 can be movably coupled to another housing portion in one or more of a number of ways. In other words, the coupling between housing portions of the housing 110 can be hinged, slidable, detachable, and/or any type of coupling that allows one housing portion to move relative to the coupled housing portion. To allow for the coupling between housing portions of the housing 110, each housing portion of the housing 110 can have one or more of a number of coupling features (e.g., coupling feature 114, coupling feature 116).

For example, housing portion 111 and housing portion 113 can be coupled to each other using coupling feature 114, which is disposed in part on housing portion 111 and in another part on housing portion 113. FIG. 1 also shows that coupling feature 116 is used to couple housing portion 112 to housing portion 113. Similarly, coupling feature 121 is used to couple housing portion 117 to housing portion 113, and coupling feature 124 is used to couple housing portion 118 to housing portion 113.

Such coupling features can include, but are not limited to, a portion of a hinge, an aperture, a slot, a tab, a detent, and a mating thread. Two housing portions of the housing 110 can be coupled to each other by the direct use of the coupling features disposed on each housing portion of the housing 110. In addition, or in the alternative, two housing portions of the housing 110 can be coupled to each other using one or more independent devices that interact with the coupling features disposed on the housing portions. Examples of such devices can include, but are not limited to, a pin, a hinge, a fastening device (e.g., screw, bolt), and a spring.

The one or more coupling features between adjacent housing portions of the housing 110 can allow one or more of those housing portions to move relative to the adjacent housing portion. Two or more housing portions of the housing 110 can be coupled using the same coupling feature. The movement of the housing portions of the housing 110 relative to each other can be rotational, spiral, linear, and/or some other type of movement. The movement of one housing portion relative to another housing portion can be limited within a range of motion (e.g., if rotational, between −90° and +90°; if linear, up to 4 inches) or unlimited.

In certain example embodiments, a housing portion of the housing 110 can have one or more receiving features. Such receiving features can be used to receive the frame 120 and/or a light module 155. A receiving feature of a housing portion of the housing 110 can include, but is not limited to, an aperture, a slot, a tab, a detent, and a mating thread. The receiving feature of the housing 110 can be coupled to the frame 120 by the direct use of the receiving feature disposed on each housing portion of the housing 110. In addition, or in the alternative, a housing portion of the housing 110 can be coupled to the frame 120 using one or more independent devices that interact with the receiving features disposed on the housing portion of the housing 110. Examples of such devices can include, but are not limited to, a pin, a hinge, a fastening device (e.g., screw, bolt), and a spring.

In certain example embodiments, a receiving feature can allow for movement of the frame 120 relative to the housing 110. For example, a receiving feature can be used to allow the frame 120 to rotate relative to the housing 110. One or more receiving features that mechanically couple the frame 120 to the housing 110 can also be used to transmit and/or provide for wiring to traverse therethrough for transmitting power and/or control signals between a power source 190 and one or more light modules 155. Each light module 155 can be provided power and/or control signals from a power source 190 in such a way that removing one light module 155 does not affect the performance of the rest of the light modules 155 for the light fixture 100.

A housing portion of the housing 110 can be a flap (e.g., housing portion 111, housing portion 112) when such housing portion is lacking one or more features (e.g., a power source 190, a receiving feature) that are disposed on at least one other portion of the light fixture 100. A flap can be optional in a light fixture 100. In certain example embodiments, a flap is located on an outer perimeter of the housing 110 of the light fixture 100. A flap can be used to help shape and/or direct light emitted by the light modules 155. A flap of the housing 110 can be made of one or more of a number of suitable materials, including but not limited to metal, glass (as with a mirror), and plastic. In some cases, one or more sides of a flap can be coated with a material that has reflective, refractive, and/or one or more other characteristics that allow the light emitted by a light module 155 to be altered and/or controlled.

Similarly, a housing portion (e.g., housing portion 113) that is not a flap can be made of one or more of a number of suitable materials, including but not limited to metal, glass (as with a mirror), ceramic, and plastic. In some cases, one or more sides of a housing portion can be coated with a material that has reflective, refractive, and/or one or more other characteristics that allow the light emitted by a light module 155 to be altered and/or controlled. In addition, when a power source 190 is mounted on a housing portion, the housing portion can have one or more features (e.g., protrusions, fins) and/or properties (e.g., constructed of thermally conductive material) that allow for receiving and subsequently dissipating heat generated by the power source 190.

When two housing portions (e.g., housing portion 113, housing portion 111) are mechanically coupled to each other, one housing portion can be moved relative to the other housing portion in one or more of a number of ways. For example, a user can manually adjust one housing portion relative to the other housing portion. In such a case, the user can move one or more housing portions with or without the use of tools. As another example, one housing portion can move relative to another housing portion using a control unit (not shown) located on or proximate to the housing 110. In such a case, the control unit can be controlled by a user and/or based on the occurrence of some event (e.g., passage of time, detection of light, a temperature measurement, dimmer setting of a light module 155). In the latter case, the control unit can receive instructions to move one or more housing portions of the housing 110 based on software instructions executed on a hardware processor, an integrated circuit, and/or some other programmable device.

In certain example embodiments, the frame 120 is mechanically coupled to one or more housing portions (e.g., housing portion 113) of the housing 110 using one or more receiving features. For example, as shown in FIGS. 2A-2D, the frame 120 can be suspended from the housing 110. In such a case, the frame 120 can be suspended from the housing 110 fixedly (e.g., by one or more brackets) and/or flexibly (e.g., by one or more chains). The distance between some or all of the frame 120 and the housing 110 can be fixed or adjustable by a user. In addition, the distance between various portions of the frame 120 relative to the housing 110 can be uniform or non-uniform.

The frame 120 can be used to secure and position one or more light modules 155. The frame 120 can also provide power and/or control signals from a power source 190 to a light source 155. For example, some or all of the frame 120 can have one or more walls that form a cavity, through which one or more wires can be disposed. In such a case, the one or more wires can be used to mechanically couple a light source 155 to a power source 190. If there is not frame 120, a light source 155 can be directly coupled to a receiving feature, The frame 120 can be made of one or more of a number of materials, including but not limited to metal, plastic, ceramic, fiberglass, and rubber. The frame 120 can have one or more of a number of components disposed in one or more of a number of configurations. For example, as shown in FIG. 1B, the frame 120 can have a lattice structure that includes an outer perimeter of a top member 181, a bottom member 182, a left side member 184, and a right side member 183. This outer perimeter forms a rectangle, but any other shape (e.g., triangle, trapezoid, square, circle) can be formed by one or more members of the frame 120.

The outer perimeter of the frame 120 can encompass one or more light modules 155 and/or one or more other members of the frame 120. In the example shown in FIGS. 1A and 1B, there are four light modules 155. Supporting the four light modules 155 are a number of members inside of, and attached to, the perimeter of the frame 120. For example, as shown in FIG. 1B, a vertical member 186 can be coupled to the approximate midpoint of (or some other point along) the top member 181 and the bottom member 182. Similarly, a horizontal member 185 can be coupled to the approximate midpoint of (or some other point along) the left side member 184 and the right side member 183.

Further, a number of other members (e.g., support members) of the frame 120 can be used to couple to each light module 155. For example, support member 161 can be coupled to the right side member 183 and one side of a light module 155, and support member 162 can be coupled to the vertical member 186 and the other side of the same light module 155. As another example, support member 163 can be coupled to the right side member 183 and one side of a light module 155, and support member 164 can be coupled to the vertical member 186 and the other side of the same light module 155.

As yet another example, support member 165 can be coupled to the left side member 184 and one side of a light module 155, and support member 166 can be coupled to the vertical member 186 and the other side of the same light module 155. In such a case, the support member 166 and the support member 162 can be the same member or different members. As still another example, support member 167 can be coupled to the left side member 184 and one side of a light module 155, and support member 168 can be coupled to the vertical member 186 and the other side of the same light module 155. In such a case, the support member 168 and the support member 164 can be the same member or different members.

When one or more members of the frame 120 is coupled to a light module 155, one or more control devices 154 can be used. A control device 154 can be a mechanical coupling between the light module 155 and a frame member that allows for the positioning of the light module 155 in a certain orientation when the light module 155 is coupled to the frame member. For example, as shown in FIGS. 1A and 1B, the control devices 154 of the light fixture 100 allow each light module 155 to rotate along an axis formed by the frame members (e.g., frame member 163, frame member 164) to which the light module 155 is coupled.

A control device 154 can be disposed at one or more points on a light module 155. When there are multiple control devices 154, each control device 154 can be the same as, or different than, the other control devices 154. A control device 154 can be mechanical or electro-mechanical. For example, when mechanical, the control device 154 can include one or more detents, an aperture, a fastening device, a clamp, a slot, and/or some other feature that allows a user to move and then fix the position of the light module 155 relative to the frame 120. When the control device 154 is electro-mechanical, a motorized device, controlled by a control unit (as shown in FIG. 2C below) can work independently of, or in conjunction with, the mechanical features listed above to allow a user to move and then fix the position of the light module 155 relative to the frame 120. In any case, the light module 155 can be configured to be compatible with and/or include one or more control devices 154.

Similarly, movement of a housing portion relative to an adjacent housing portion and/or a frame portion relative to an adjacent frame portion (described below) can be performed manually or electro-mechanically. When performed electro-mechanically, the control unit can work in conjunction with one or more local control devices (similar to the control devices 154 described above) disposed on or proximate to the housing portion and/or the frame portion.

One member of the frame 120 (also sometimes called a frame member) can be coupled to another member of the frame 120 in one or more of a number of ways. Specifically, one member can be coupled to another member of the frame 120 fixedly or movable (e.g., rotatably, slidably). Further, one member can be coupled to another member of the frame 120 using one or more of a number of coupling methods, including but not limited to welding, epoxy, fastening devices (e.g., bolts, nuts), mating threads, clamps, brackets, slots, compression fittings, and tabs. Each member of the frame 120 can have one or more of a number of shapes, sizes, and dimensions. For example, a member of the frame 120 can be a rod with a cross-sectional shape that is circular, triangular, square, hexagonal, or any other shape. As another example, a member of the frame 120 can be an elongated bar with a cross-sectional shape that is oval, rectangular, hexagonal, or any other shape.

The light modules 155 can be a component that includes one or more light sources 158 of one or more types (e.g., LED), as described above. The one or more light sources 158 can form an array 157 of light sources 158. Each light source 158 can be mounted on a base 159 of the light module 155. A light fixture 100 can have one or more light modules 155. If there are multiple light modules 155, one light module 155 can be substantially the same as, or different (e.g., shape, size, power consumption, lens color, type of light source) than, one or more of the other light modules 155. Each light module 155 can have one or more of a number of frame receivers 156 disposed in and/or on its housing 131. Such frame receivers 156 can be a hole, an electrical connector (e.g., male end, female end), a slot, a tab, a detent, a clip, and/or any other suitable device or component that allowed the light module 155 to mechanically couple to a portion of the frame 120.

The frame receivers 156 of a light module 155 can be configured to allow for easy connection to/disconnection from one or more portions of the frame 120, as well as a secure connection to the frame 120 when the light module 155 is coupled to the frame 120. When the light module 155 is mechanically coupled to the frame 120, the position of the light module 155 relative to the frame 120 can be changed. For example, a light module 155 can be rotated about an axis formed by two frame receivers (e.g., frame receiver 1542, frame receiver 156) disposed on either side of the light module 155. The position of a light module 155 relative to the frame 120 can be changed in one or more of a number of ways.

For example, a user can manually adjust a light module 155 relative to the frame 120. In such a case, the user can move the light module 155 with or without the use of tools. As another example, a light module 155 can move relative to the frame 120 using a control unit (not shown) located on or proximate to the frame 120. In such a case, the control unit can be controlled by a user and/or based on the occurrence of some event (e.g., passage of time, detection of light, a temperature measurement, dimmer level of a light module 155). In the latter case, the control unit can receive instructions to move one or more portions of the housing 110 based on software instructions executed on a hardware processor, an integrated circuit, and/or some other programmable device. The control unit used to move a light module 155 can be the same as, or different than, the light control unit described above with respect to moving a housing portion of the housing 110.

Each light module 155 can include a thermally conductive material (e.g., housing 131) in thermal communication with the light source so that heat generated by the light source is received and dissipated by the thermally conductive material. A light module 155 can include one or more diffusers (e.g., a lens) made of one or more of a number of suitable materials (e.g., glass, plastic). Alternatively, a light module 155 can have no diffuser.

Each power source 190 can be affixed to some part of the housing 110. For example, as shown in FIG. 1, a power source 190 can be coupled to a top surface of a housing portion (e.g., housing portion 113). Each power source 190 can include one or more of a number of components (e.g., transformer, resistor, capacitor, integrated circuit) that can be discrete components, components integrated with a circuit board, and/or functions performed by components that are programmed into a hardware processor. The power source 190 receives power and/or control information from a source (via or a switch or control device communicably coupled to the power source 190), converts the power and/or control to a corresponding signal (e.g., voltage, current), and sends the corresponding signal to the one or more light modules 155 to control the operational characteristics of the light modules 155.

When the power source 190 is mounted on the top surface of a housing portion or at some other location, the power source 190 can be enclosed so that none of the components of the power source 190 is exposed. In certain example embodiments, the power source 190 is located remotely from the remainder of the light fixture 100. The power source 190 can transmit power and/or control with the one or more light modules 155 using wired and/or wireless technology.

Figure 2B:
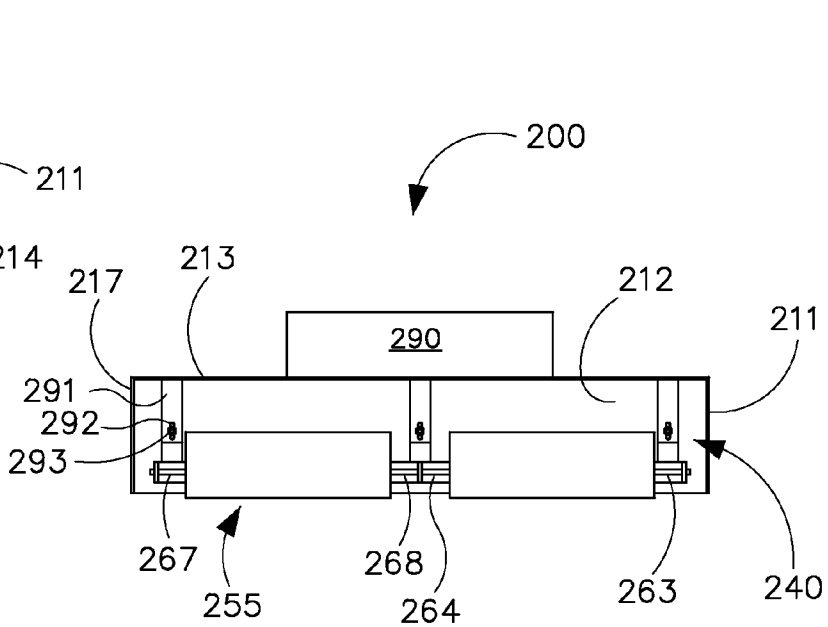
FIGS. 2A-2D show various views of example light fixtures in accordance with certain example embodiments.
Figure 2A:
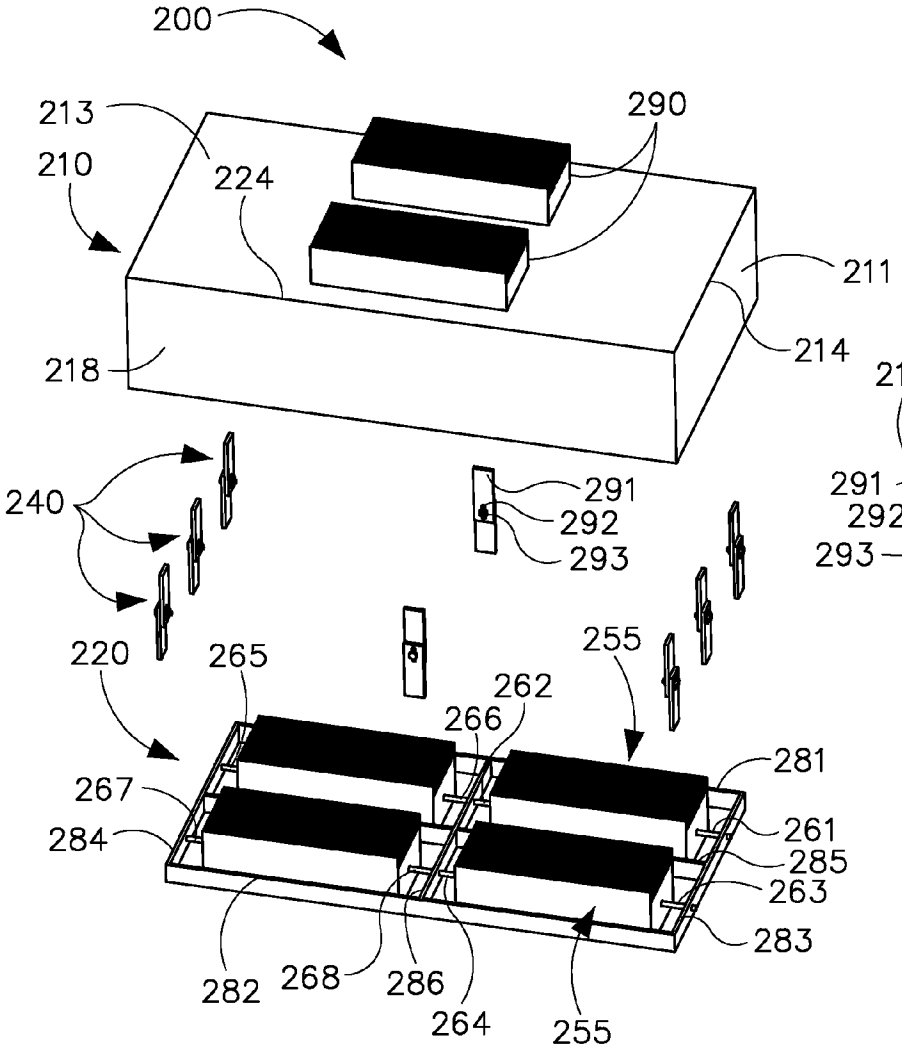
Figure 2D:
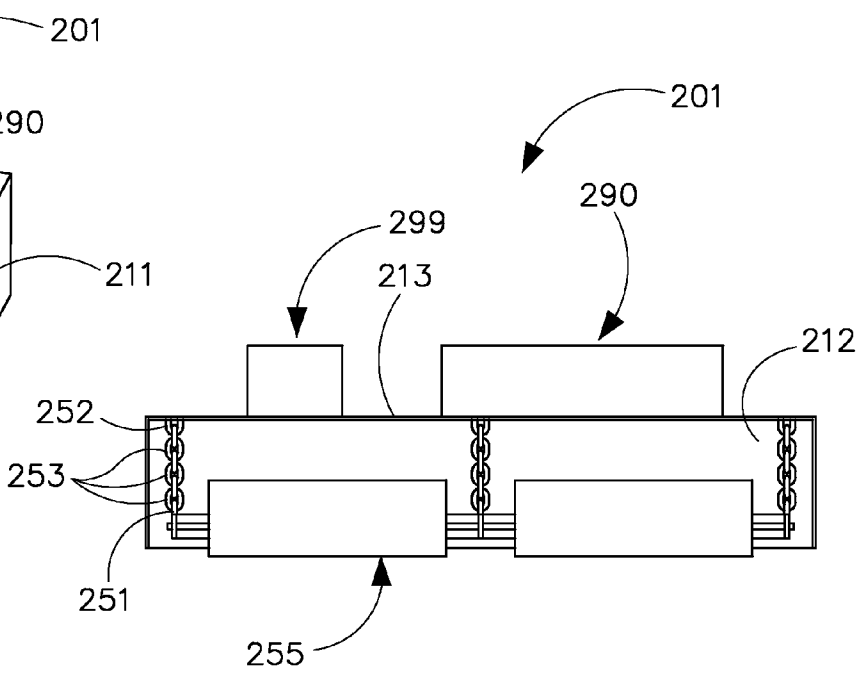
Figure 2C:
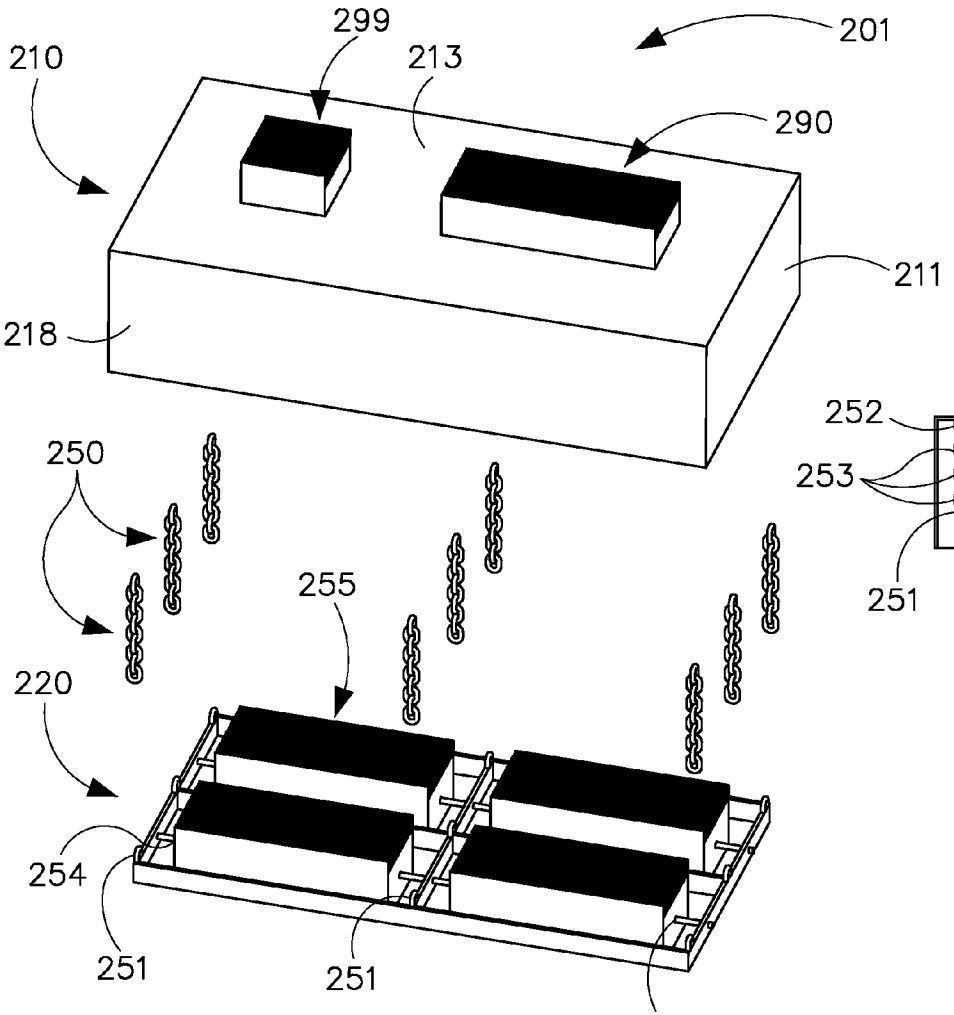

FIGS. 2A-2D show various views of example light fixtures in accordance with certain example embodiments. Specifically, FIG. 2A shows an exploded view of an example light fixture 200. FIG. 2B shows a cross-sectional side view of the light fixture 200 of FIG. 2A. FIG. 2C shows an exploded view of another example light fixture 201. FIG. 2D shows a cross-sectional side view of the light fixture 201 of FIG. 2C. In one or more example embodiments, one or more of the components shown in FIGS. 2A-2D may be omitted, repeated, and/or substituted. Accordingly, example embodiments of light fixtures (or portions thereof) should not be considered limited to the specific arrangements of components shown in FIGS. 2A-2D.

Referring now to FIGS. 1A-2D, the light fixture 200 of FIGS. 2A and 2B can include a housing 210, a frame 220, one or more power sources 290, and one or more light modules 255. Similarly, the light fixture 201 of FIGS. 2C and 2D can include a housing 210, a frame 220, one or more power sources 290, and a number of light modules 255. The housing 210, frame 220, power sources 290, and light modules 255 of FIGS. 2A-2D are substantially the same as the housing 110, frame 120, power sources 190, and light modules 155 of FIGS. 1A and 1B, except as described below. The description for any component (e.g., housing portion 213, top member 281) of FIGS. 2A-2D not provided below can be considered substantially the same as the corresponding component (e.g., housing portion 113, top member 181) described above with respect to FIGS. 1A and 1B. The numbering scheme for the components of FIGS. 2A-2D parallel the numbering scheme for the components of FIGS. 1A and 1B in that each component is a three digit number, where similar components between the housing 210, frame 220, power sources 290, and light modules 255 of FIGS. 2A-2D and the housing 110, frame 120, power sources 190, and light modules 155 have the identical last two digits.

The light fixture 200 of FIGS. 2A and 2B show an example of a receiving feature 240 of the housing 210. In this case, each receiving feature 240 is an adjustable strap that includes a body 291 with an aperture 292 that traverses at least a portion of the length (height) of the body 291. The body 291 can be a single piece or multiple pieces that are movably coupled to each other. If the body 291 is a single piece, the body 291 can be made of flexible material that allows the length of the body 291 to be changed at least once from its original length. If the body 291 is multiple pieces, the multiple pieces can be movably coupled to each other using one or more of a number of coupling methods, including but not limited to mating threads, slots, tabs, detents, and fastening devices (e.g., fastening device 293).

For example, in this case, the receiving feature 240 can also include a body 291 having two pieces that are movably coupled to each other using mating threads. One or more fastening devices 293 (e.g., a nut) is used to keep the two pieces of the body secured so that the length of the body 291 remains constant. Those having skill in the art will appreciate that there are a number of ways that the receiving feature 240 can be configured to allow the length of the body to be adjusted one or more times by a user and remain at a substantially fixed length for a period of time, until later changed by a user, in spite of vibrations, the weight of the frame 220 and light modules 255, and/or any other conditions that the light fixture 200 can be exposed to during use.

The receiving feature 240 can be fixedly or removably coupled to a housing portion (in this case, housing portion 213) using one or more of a number of coupling methods, including but not limited to welding, mating threads, compression fittings, slots, tabs, and detents. In certain example embodiments, some or all of the receiving feature 240 forms a single piece with the housing portion, as from a mold or casting process. Similarly, the receiving feature 240 can be fixedly or removably coupled to the frame 220 using one or more of a number of coupling methods. The receiving feature 240 can be made from one or more of a number of a number of suitable materials, including but not limited to metal, plastic, rubber, and ceramic.

The number of receiving features 240 used in a light fixture 200 can vary. In this example, there are nine receiving features 240 that form a 3×3 grid. The receiving features 240 can be distributed so that the frame 220 is held in a stable position relative to the housing 210. Here, the receiving features 240 are distributed substantially evenly along the length and width of the frame 220. For example, as shown in FIGS. 2A and 2B, a receiving feature 240 is coupled to the intersection of the left side member 284 and the horizontal member 285 of the frame 220. Another receiving feature 240 is coupled to the intersection of the vertical member 286 and the horizontal member 285 of the frame 220. Another receiving feature 240 is coupled to the intersection of the right side member 283 and the horizontal member 285 of the frame 220. In addition, the frame 220 is positioned in the substantial center of the housing portion 213 using the receiving features 240.

The receiving features 240 can be adjusted so that the frame 220 has a particular orientation with respect to a housing portion (e.g., housing portion 213). For example, in this case, the receiving features 240 can be adjusted so that the frame 220 is substantially parallel with housing portion 213. As another example, the receiving features 240 can be adjusted so that the frame 220 is set at a particular angle (i.e., antiparallel) relative to the housing portion 213. As with the light fixture 100 of FIG. 1, housing portions 211, 212, 217, and 218 of the light fixture 200 are flaps (do not have any receiving features) and are each adjustable relative to housing portion 213 using coupling features 214, 216, 221, and 224, respectively.

The light fixture 201 of FIGS. 2C and 2D shows a different type of receiving feature 250. In this case, the receiving features 250 are chains with a number of interlocking links 253. Disposed on a housing portion (in this case, housing portion 213) is one or more chain receivers 252 (e.g., hooks) that are configured to receive and couple to one or more links 253 of the chain. Similarly, disposed on the frame 220 are one or more chain receivers 251 that receive and couple to one or more other links 253 of the chain.

The chain receivers 252 can be fixedly or removably coupled to a housing portion of the housing 210. Similarly, the chain receivers 251 can be fixedly or removably coupled to the frame 220. A chain receiver 252 can be coupled to a housing portion and a chain receiver 251 can be coupled to the frame 220 using one or more of a number of coupling methods, including but not limited to welding, epoxy, fastening devices, compression fittings, slots, and tabs. In addition, the light fixture 201 shows a control unit 299 that can be used to control one or more of the control devices 254. In such a case, the control devices 254 coupled to the control unit 299 can be electro-mechanical. The control unit 299 can be electrically coupled to, or decoupled from, the power source 290.

Figure 3:
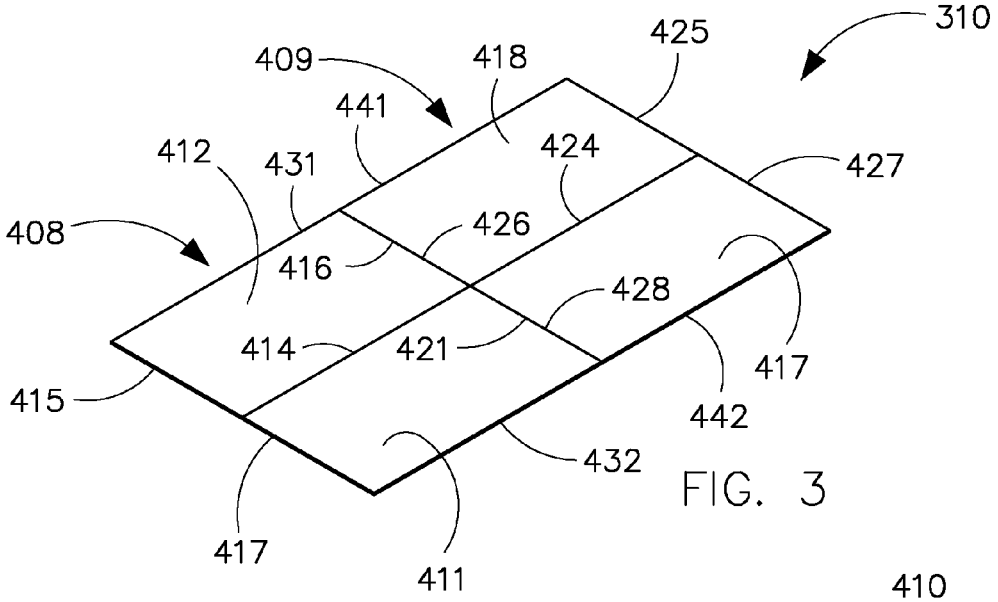
FIG. 3 shows a perspective view of a housing for a light fixture in accordance with certain example embodiments.

FIG. 3 shows a perspective view of a housing 310 for a light fixture in accordance with certain example embodiments. In one or more example embodiments, one or more of the components shown in FIG. 3 may be omitted, repeated, and/or substituted. Accordingly, example embodiments of a housing (or portions thereof) should not be considered limited to the specific arrangements of components shown in FIG. 3.

Referring to FIGS. 1A-3, the housing 310 of FIG. 3 includes four housing portions that each have the substantially same shape and size compared to the other housing portions. Specifically, the housing portions in FIG. 3 form a 2×2 grid, with housing portion 412 in the upper left, housing portion 418 in the upper right, housing portion 411 in the lower left, and housing portion 417 in the lower right. Each housing portion is substantially a rectangle in shape. Each housing portion can have one or more receiving features (hidden from view) disposed on a bottom surface of the housing portion.

Each housing portion in this example housing 310 has one or more coupling features on each of its side. Housing portion 412 has a coupling feature 431 on its top side, a coupling feature 414 on its bottom side, a coupling feature 415 on its left side, and a coupling feature 416 on its right side. Housing portion 411 has the coupling feature 414 on its top side, a coupling feature 432 on its bottom side, a coupling feature 417 on its left side, and a coupling feature 421 on its right side. Housing portion 418 has a coupling feature 441 on its top side, a coupling feature 424 on its bottom side, a coupling feature 426 on its left side, and a coupling feature 425 on its right side. Housing portion 417 has the coupling feature 424 on its top side, a coupling feature 442 on its bottom side, a coupling feature 428 on its left side, and a coupling feature 427 on its right side.

In some cases, coupling feature 416 and coupling feature 426 are the same coupling feature. Similarly, coupling feature 421 and coupling feature 428 can be the same coupling feature. Many of the coupling features in this case are not utilized. In other words, there is no adjacent housing portion for coupling feature 431, coupling feature 415, coupling feature 417, coupling feature 432, coupling feature 442, coupling feature 427, coupling feature 425, and coupling feature 441. However, the housing 310 can be modularly expanded in any direction by adding housing portions that are compatible with one or more of these unutilized coupling features.

In certain example embodiments, the housing 310 can be divided into two or more housing sections. A housing section of a housing 310 is one or more housing portions that can move in conjunction with each other and independently of other housing portions (in other words, other housing sections). In this example, there are two housing sections. Housing section 408 is made up of housing portion 412 and housing portion 411, while housing section 409 is made up of housing portion 418 and housing portion 417. Thus, as shown below with respect to FIGS. 4A and 4B, coupling section 408 can move independently of coupling section 409.

Figure 4A:
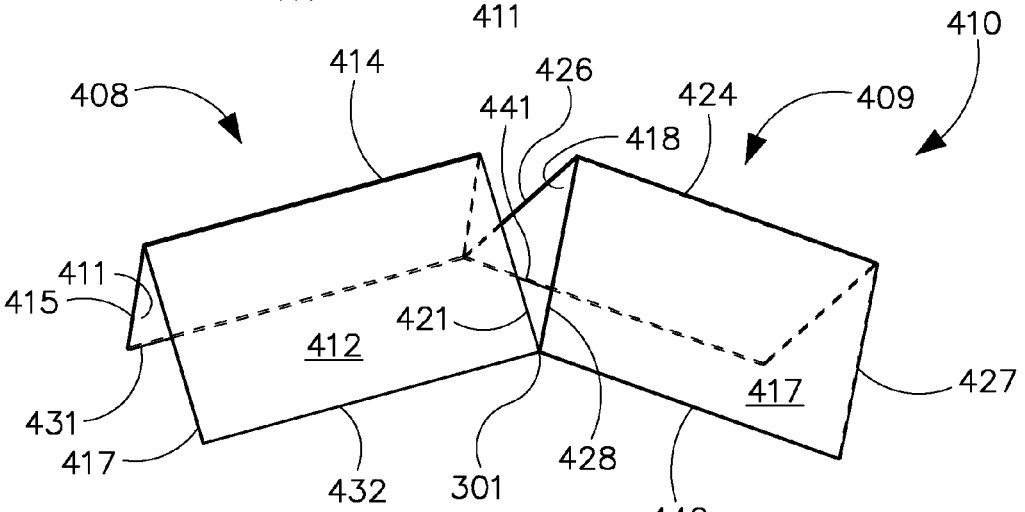
FIGS. 4A and 4B show various views of the housing of FIG. 3 in accordance with certain example embodiments.
Figure 4B:
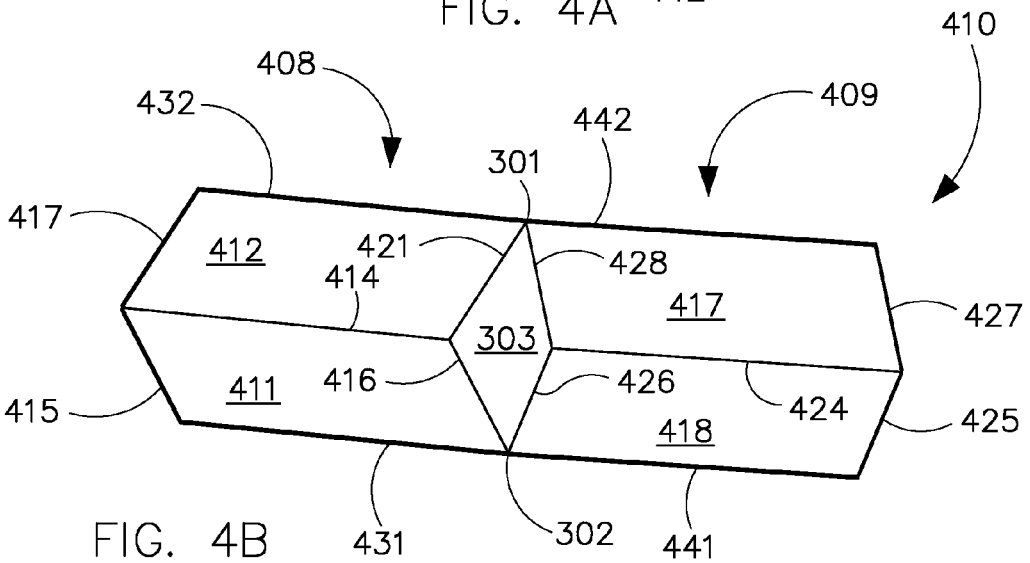
Figure 5:
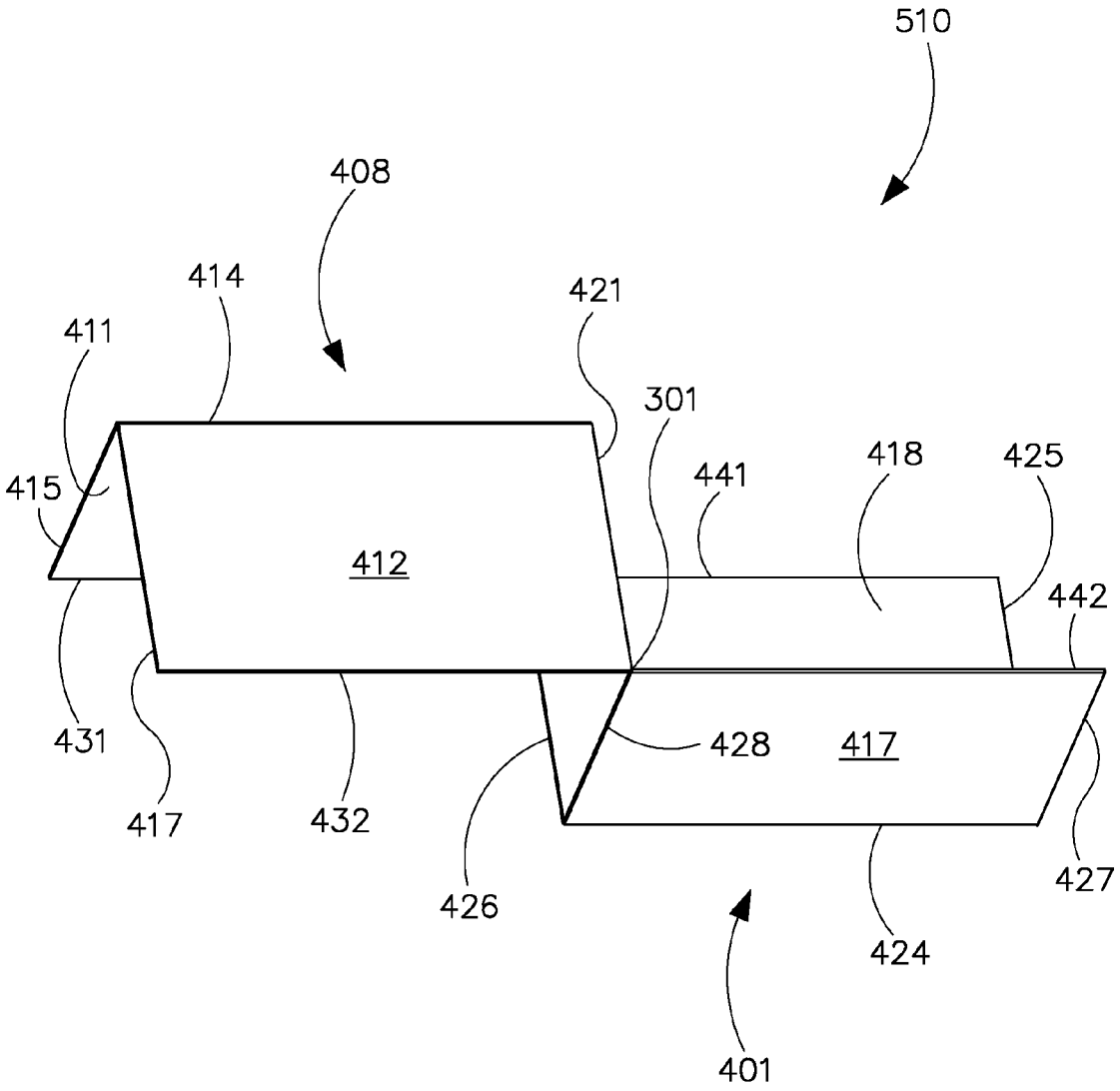
FIG. 5 shows a perspective view of the housing of FIG. 3 in accordance with certain example embodiments.

FIGS. 4A-5 show various views of the housing of FIG. 3 in accordance with certain example embodiments. Specifically, FIG. 4A shows a side perspective view of the housing 410, and FIG. 4B shows a bottom perspective view of the housing 410 in a certain orientation. FIG. 5 shows a side perspective view of the housing 510 of FIG. 3 in a different orientation from that of the housing 410 of FIGS. 4A and 4B. In one or more example embodiments, one or more of the components shown in FIGS. 4A-5 may be omitted, repeated, and/or substituted. Accordingly, example embodiments of a housing (or portions thereof) should not be considered limited to the specific arrangement of components shown in FIGS. 4A-5.

Referring to FIGS. 1A-5, the housing 410 of FIGS. 4A and 4B is arranged so that housing section 408 (housing portion 411 and housing portion 412) is partially separated from housing section 409 (housing portion 417 and housing portion 418). Specifically, housing section 408 and housing section 409 are coupled only at point 301 and point 302. In such a case, point 301 and point 302 can each be a coupling feature. Housing section 408 and housing section 409 each form a "V" shape and are slightly directed toward each other, forming a gap 303 therebetween. Thus, housing portions within a housing section can be positioned in certain positions (e.g., at some angle) relative to each other. In addition, or in the alternative, housing sections within a housing can be positioned in certain positions (e.g., at some angle) relative to each other.

Housing section 408, which in this case includes housing portion 411 and housing section 412, are joined by coupling feature 414. Similarly, housing section 409, which in this case includes housing portion 417 and housing portion 418, are joined by coupling feature 424. Coupling feature 301 and coupling feature 302 can be used to hold housing section 408 in a fixed position relative to housing section 409. By having the housing 310 split into two housing sections, each housing section 408 and 409 can be separately manipulated and positioned relative to each other. As stated above, . . . .

FIG. 5 shows a different example of how housing section 408 and housing section 409 can be separately manipulated and positioned relative to each other. Specifically, housing 510 of FIG. 5 shows that housing section 408 and housing section 409 each forms a "V" shape, where the shape of housing section 409 is inverted relative to the shape of housing section 408. While two examples of housing orientations are shown here with two housing sections each having two housing portions, other housing orientations are possible with one or more housing sections each having one or more housing portions.

Figure 6A:
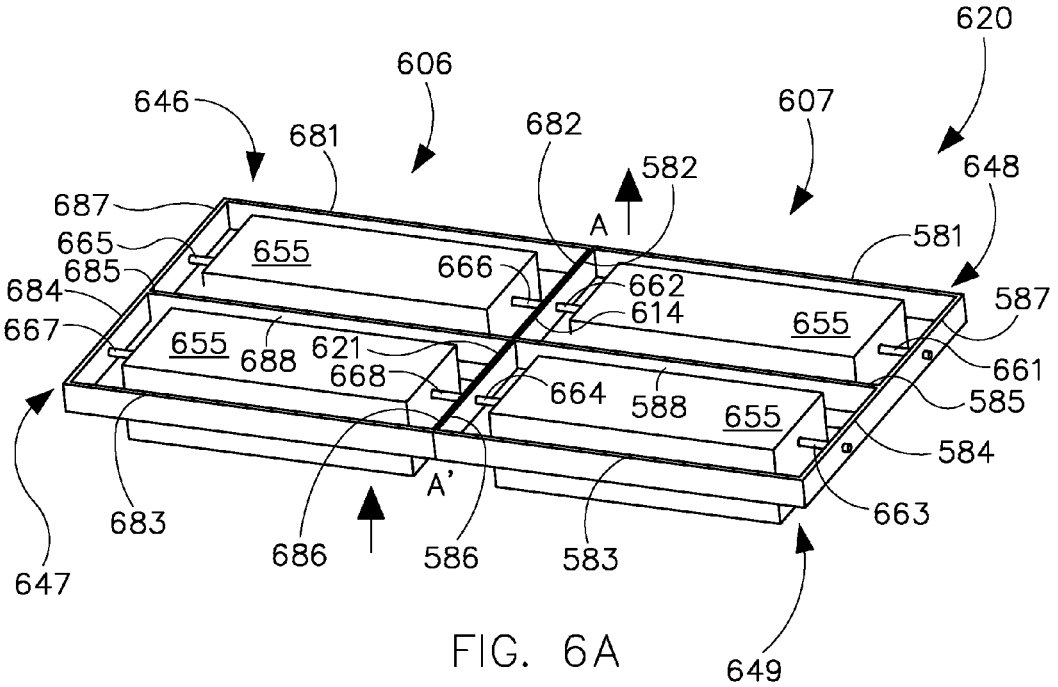
FIGS. 6A and 6B show various views of a frame for a light fixture in accordance with certain example embodiments.
Figure 6B:
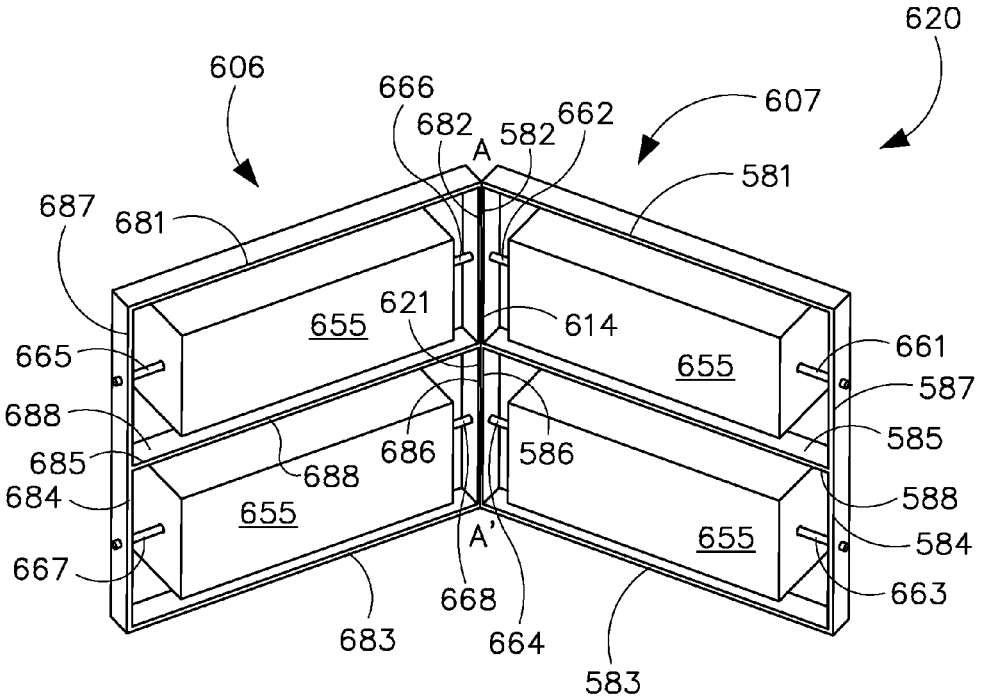

FIGS. 6A and 6B show various views of a frame 620 for a light fixture in accordance with certain example embodiments. Specifically, FIG. 6A shows a perspective view of the frame 620 in one position, and FIG. 6B shows a perspective view of the frame 620 in a different position. In one or more example embodiments, one or more of the components shown in FIGS. 6A and 6B may be omitted, repeated, and/or substituted. Accordingly, example embodiments of a frame (or portions thereof) should not be considered limited to the specific arrangements of components shown in FIGS. 6A and 6B.

Referring now to FIGS. 1A-6B, the frame of FIGS. 6A and 6B are substantially the same as the frame 220 of FIGS. 2A-2D, except as described below. The description for any component (e.g., light module 655, top member 681, top member 581) of FIGS. 6A and 6B not provided below can be considered substantially the same as the corresponding component (e.g., light module 255, top member 281) described above with respect to FIGS. 2A-2D. The numbering scheme for the components of FIGS. 6A and 6B parallel the numbering scheme for the components of FIGS. 2A-2D in that each component is a three digit number, where similar components between the frame 620 of FIGS. 6A and 6B and the frame 220 of FIGS. 2A-2D have the identical last two digits.

As with the housing, the frame 620 can be defined by portions and/or sections. In this example, there are two frame sections and four frame portions for the frame 620. Frame section 606 is the left half of the frame 620, and frame section 607 is the right half of the frame 620. Frame section 606 includes frame portion 646 (defined by frame member 681, frame member 682, frame member 685, frame member 687, frame member 665, and frame member 666) and frame portion 647 (defined by frame member 688, frame member 686, frame member 683, frame member 684, frame member 667, and frame member 668). Frame section 607 includes frame portion 648 (defined by frame member 581, frame member 582, frame member 585, frame member 587, frame member 661, and frame member 662) and frame portion 649 (defined by frame member 588, frame member 582, frame member 583, frame member 584, frame member 663, and frame member 664). While each frame portion is shown having one light module 665, a frame portion can have no light modules or multiple light modules 655 in any of a number of orientations and/or positioned relative to each other.

In certain example embodiments, frame section 606 and frame section 607 can move and be positioned relative to each other, as shown in FIG. 6B. Thus, a frame 620 can have one or more coupling features to allow for additional positioning of one or more light modules 655 coupled to the frame 620. For example, in this case, the frame 620 includes coupling feature 614, disposed on frame member 682 of frame portion 646 and frame member 582 of frame portion 648. The frame 620 also includes coupling feature 621, disposed on frame member 686 of frame portion 647 and frame member 586 of frame portion 649.

The frame 620 can also include one or more other coupling features. For example, a coupling feature can be disposed on frame portion 685 and frame portion 688. As another example, a coupling feature can be disposed on frame portion 585 and frame portion 588. A coupling feature for the frame 620 can be substantially the same as a coupling feature described above with respect to the housing. By using frame members that include coupling features, the frame can be expanded and/or positioned in a number of different positions relative to the rest of the frame.

By using one or more coupling features with the frame 620, the frame can move and be put in a position in conjunction with a position of the housing when the housing and the frame 620 are coupled to each other using one or more receiving features. Alternatively, using coupling features with the frame 620 can allow the frame 620 to be moved and positioned independent of the housing portions to which the frame 620 is attached. Thus, frame portions within a frame section can be positioned in certain positions (e.g., at some angle) relative to each other. In addition, or in the alternative, frame sections within a frame can be positioned in certain positions (e.g., at some angle) relative to each other.

In one or more example embodiments, example light fixtures described herein allow for mechanical, electrical, and/or optical expansion of the light fixture. In addition, or in the alternative, example light fixtures can be adjusted with respect to the housing, the frame, the distance and/or orientation between the frame and the housing, and/or the orientation of the light modules. Such adjustments can be made manually by a user or using a control unit. Thus, example light fixtures allow for adaptability based on changing conditions, changing locations, and/or changing needs. Example light fixtures can comply with one or more of a number of standards and/or regulations, allowing for use in various applications and/or various orientations of the light fixture in such uses.

Accordingly, many modifications and other embodiments set forth herein will come to mind to one skilled in the art to which light fixtures pertain having the benefit of the teachings presented in the foregoing descriptions and the associated drawings. Therefore, it is to be understood that light fixtures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light fixture, comprising:

at least one first light module;

a housing;

at least one first support member coupled to the housing; and a frame comprising:

a first frame portion comprising at least one first frame coupling feature, at least one first housing coupling feature, and at least one first receiving feature, wherein the at least one first receiving feature mechanically couples to the at least one first light module; and a second frame portion comprising at least one second frame coupling feature, wherein the at least one second frame coupling feature mechanically couples to the at least one first frame coupling feature of the first frame portion, wherein a first position of a plurality of positions of the first frame portion relative to the second frame portion is changed to a second position of the plurality of positions using the at least one first frame coupling feature and the at least one second frame coupling feature, wherein the at least one first support member suspends the first frame portion at a first distance from the housing, and wherein the at least one first light module has a first adjustable orientation, using the at least one first receiving feature, with respect to the first frame portion.

2. The light fixture of claim 1, wherein the second frame portion further comprises at least one second receiving feature, wherein the at least one second receiving feature couples to at least one second light module.

3. The light fixture of claim 2, wherein the at least one second light module has a second adjustable orientation, using the at least one second receiving feature, with respect to the second frame portion.

4. The light fixture of claim 1, wherein the at least one first light module rotates along a first axis along a length of the at least one first light module with respect to the first frame portion, wherein the at least one first light module mechanically couples to the at least one first support member of the first frame portion along the first axis.

5. The light fixture of claim 1, wherein the first distance between the first frame portion and the housing, using the at least one first support member, is adjustable, wherein the first adjustable orientation of the at least one first light module is independent of adjusting the first distance between the first frame portion and the housing.

6. The light fixture of claim 1, further comprising:

at least one second support member that couples to the second frame portion and the housing.

7. The light fixture of claim 1, wherein the second frame portion moves relative to the first frame portion when the first frame portion remains fixed relative to the housing.

8. The light fixture of claim 1, wherein the first frame portion rotates, using the at least one first support member, relative to the housing.

9. The light fixture of claim 1, further comprising:

a third frame portion comprising the at least one third frame coupling feature and at least one third receiving feature, wherein the at least one third receiving feature mechanically couples to at least one third light module, wherein the first frame portion and the second frame portion are part of a first frame section, wherein the third frame portion is part of a second frame section, and wherein the first frame section and the second frame section are movably coupled to each other using the at least one third frame coupling feature.

10. The light fixture of claim 9, wherein the third frame portion is mechanically coupled to the housing using the at least one third support member coupled to the housing and the third frame portion.

11. The light fixture of claim 10, wherein the third support member suspends the third frame portion from the housing at an adjustable second distance.

12. The light fixture of claim 1, wherein the first frame portion and the second frame portion are positioned an obtuse or an acute angle relative to each other.

13. The light fixture of claim 1, wherein the at least one first light module comprises a plurality of first light modules, wherein one of the plurality of first light modules is movable relative to the first frame portion independent of a remainder of the plurality of first light modules.

14. The light fixture of claim 1, wherein the at least one first light module comprises a plurality of first light modules, wherein one of the plurality of first light modules is removed without affecting a performance of a remainder of the plurality of first light modules.

15. A frame for a light fixture, the frame comprising:

a first frame portion comprising at least one first housing coupling feature, at least one first frame coupling feature, and at least one first support member, wherein the at least one first housing coupling feature is configured to couple to at least one receiving feature of the light fixture, wherein the at least one first support member is configured to receive at least one first light module, wherein the at least one first receiving feature suspends the first frame at a first adjustable distance from a housing of the light fixture; and a second frame portion comprising at least one second frame coupling feature and at least one second support member, wherein the at least one second frame coupling feature movably couples to the at least one first frame coupling feature, and wherein the at least one second support member is configured to receive at least one second light module, wherein a position of the first frame portion relative to the second frame portion is changed using the at least one first frame coupling feature and the at least one second frame coupling feature, wherein the at least one first light module has a first adjustable orientation with respect to the first frame using the at least one first support member, and wherein the at least one second light module has a second adjustable orientation with respect to the second frame using the at least one second support member.

16. The frame of claim 15, wherein the second frame portion further comprises at least one second housing coupling feature, wherein the at least one second housing coupling feature is configured to receive at least one second receiving feature of the light fixture, wherein the at least one second receiving feature suspends the second frame at a second adjustable distance from the housing.

17. The frame of claim 15, further comprising:

a third frame portion comprising at least one third frame coupling feature, wherein the at least one third frame coupling feature mechanically couples to the at least one first frame coupling feature of the first frame portion.

18. The frame of claim 17, wherein the third frame portion further comprises at least one third support member that is configured to receive at least one third light module.

19. The frame of claim 18, wherein the first frame portion and the second frame portion are part of a first frame section.

20. The frame of claim 19, wherein the third frame portion is part of a second frame section that is movably coupled to the first frame section.

* * * * *